US012471719B2

(12) United States Patent
Chen

(10) Patent No.: US 12,471,719 B2
(45) Date of Patent: Nov. 18, 2025

(54) TRAVEL COT

(71) Applicant: Kunshan Aierjia Children's Products Co., Ltd, Kunshan (CN)

(72) Inventor: Xin Chen, Kunshan (CN)

(73) Assignee: SHANGHAI HUAN HSIN ELECTRONICS CO., LTD, Shanghai (CN)

( * ) Notice: Subject to any disclaimer, the term of this patent is extended or adjusted under 35 U.S.C. 154(b) by 310 days.

(21) Appl. No.: 18/205,613

(22) Filed: Jun. 5, 2023

(65) Prior Publication Data

US 2024/0180338 A1 Jun. 6, 2024

(30) Foreign Application Priority Data

Dec. 5, 2022 (CN) ..... 202211546354.7

(51) Int. Cl.
*A47D 9/00* (2006.01)

(52) U.S. Cl.
CPC ..... *A47D 9/005* (2013.01)

(58) Field of Classification Search
CPC ..... A47D 9/00; A47D 9/005; A47D 9/008; A47D 9/012; A47D 11/00; A47D 11/005; A47D 11/007; A47D 13/06; A47D 13/061; A47D 13/063; A47D 13/065; A47D 13/066; A47D 13/068; A47D 7/00; A47D 7/002; A47D 7/005; A47D 7/007; A47D 7/01; A47D 7/02
See application file for complete search history.

(56) References Cited

U.S. PATENT DOCUMENTS

2008/0189854 A1* 8/2008 Thorne ..... A47D 13/061 5/99.1
2009/0188039 A1* 7/2009 Shan ..... A47D 9/016 5/93.1
2012/0248394 A1* 10/2012 Thorne ..... A47D 13/061 256/25
2017/0290444 A1* 10/2017 Mao ..... A47D 13/063
2018/0168365 A1* 6/2018 Huang ..... A47D 7/002
2019/0142183 A1* 5/2019 Mountz ..... A47D 13/061 5/99.1
2020/0281369 A1* 9/2020 Juchniewicz ..... A47D 13/063
2022/0279938 A1* 9/2022 Mountz ..... A47D 13/063
2022/0296007 A1* 9/2022 Mao ..... A47D 13/063

* cited by examiner

*Primary Examiner* — George Sun
(74) *Attorney, Agent, or Firm* — Birch, Stewart, Kolasch & Birch, LLP

(57) ABSTRACT

A travel cot has multiple lateral fences, multiple vertical posts, and a bottom frame which includes a central body, multiple bottom rods, and multiple ropes. The bottom rods are disposed between the central body and the vertical posts respectively. To expand the travel cot, the central body moves downward and thus the ropes get taut. The vertical posts move to expand the lateral fences as a result of collective work of the central body, the bottom rods, and the ropes, and thus the travel cot is expanded and fixed. To fold the travel cot, the central body moves upward and thus ropes get loosened, and then the vertical posts are moved close to center. The ropes would no longer affect the vertical posts, bottom rods, and central body. A volume of the bottom frame gets smaller after folded.

13 Claims, 9 Drawing Sheets

TRAVEL COT

BACKGROUND OF THE INVENTION

1. Field of the Invention

The present invention relates to a travel cot, especially to a travel cot that is foldable.

2. Description of the Prior Arts

The conventional travel cots are varied according to different folding methods. A conventional travel cot usually has multiple lateral fences, multiple vertical posts, and a foldable bottom frame connecting with bottom ends of the vertical posts, and each one of the lateral fences rotatably connects with two top ends of each two adjacent said vertical posts.

There are several types of the bottom frame structures; for example, a bottom frame may have a central body disposed at a center part, multiple bottom links which connect with the central body and corresponding lower corner joints. The central body includes an upper central unit and a lower central unit which are capable of moving up and down with respect to each other. Each one of the bottom links is capable of forming a transformable triangle mechanism with the upper central units and the lower central units, and further forming a transformable four-link mechanism with the corresponding vertical post.

To overcome the shortcomings, the present invention provides a travel cot to mitigate or obviate the aforementioned problems.

SUMMARY OF THE INVENTION

The main objective of the present invention is to provide a travel cot.

The travel cot has multiple vertical posts, multiple lateral fences, and a bottom frame. The multiple lateral fences are foldable, and each one of the lateral fences connects with top ends of adjacent two of the vertical posts. The bottom frame connects with bottom ends of the vertical posts. The bottom frame includes a central body, multiple bottom rods, and multiple ropes. The central body is disposed at a bottom central region of the travel cot, and the multiple bottom rods are rotatably mounted between the central body and the vertical posts respectively. Two ends of each one of the bottom rods includes an inner end which is connected to the central body and an outer end which is connected to a corresponding one of the vertical posts via a bottom first pivot. The multiple ropes are non-stretchable and extends outward from the central body, and an outer end portion of each one of the ropes is connected to a connecting site of the bottom end of the corresponding vertical post, and the connecting site is located beneath the bottom first pivot.

The travel cot is in an expanded state when distances between each one of the vertical posts and the central body extend to a maximum, and each one of the ropes is tautly mounted between the bottom end of the corresponding vertical post and the central body, and the top ends of the vertical posts tend to expand.

The travel cot is in an expanded state when the central body moves downward to a limit position, and then the ropes get taut to pull the bottom ends of the vertical posts, such that the top ends of the vertical posts move outward to expand the lateral fences. In the folding process, the central body moves upward and leaves the limit position. As long as the central body is not in the limit position, a lower part of each one of the vertical posts moves toward the central body and thus the vertical posts get tilted and move to center of the travel cot, such that the ropes get loosened, and thereby no longer affect the vertical posts, the bottom rods, and the central body. When the central body further moves upward, the vertical posts and the bottom rods move closer to each other, so a volume of the bottom frame is smaller after folded.

The travel cot in this disclosure has advantages as follows: when the central body is pressed down to expand the bottom frame to a limit, the ropes get taut. The top ends of the vertical posts then move outward and expand the lateral fences as a result of collective work of the bottom rods and the ropes. Therefore, the travel cot is in expanded state and locked. In a folding process of the travel cot, the central body moves upward and thus the ropes get loosened, and then the vertical posts are moved close to center by traction of the central body and the bottom rods together. The ropes would no longer affect the vertical posts, bottom rods, and central body in the folding process. A volume of the bottom frame is smaller after folded, and the structure is simple and costs less to produce.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
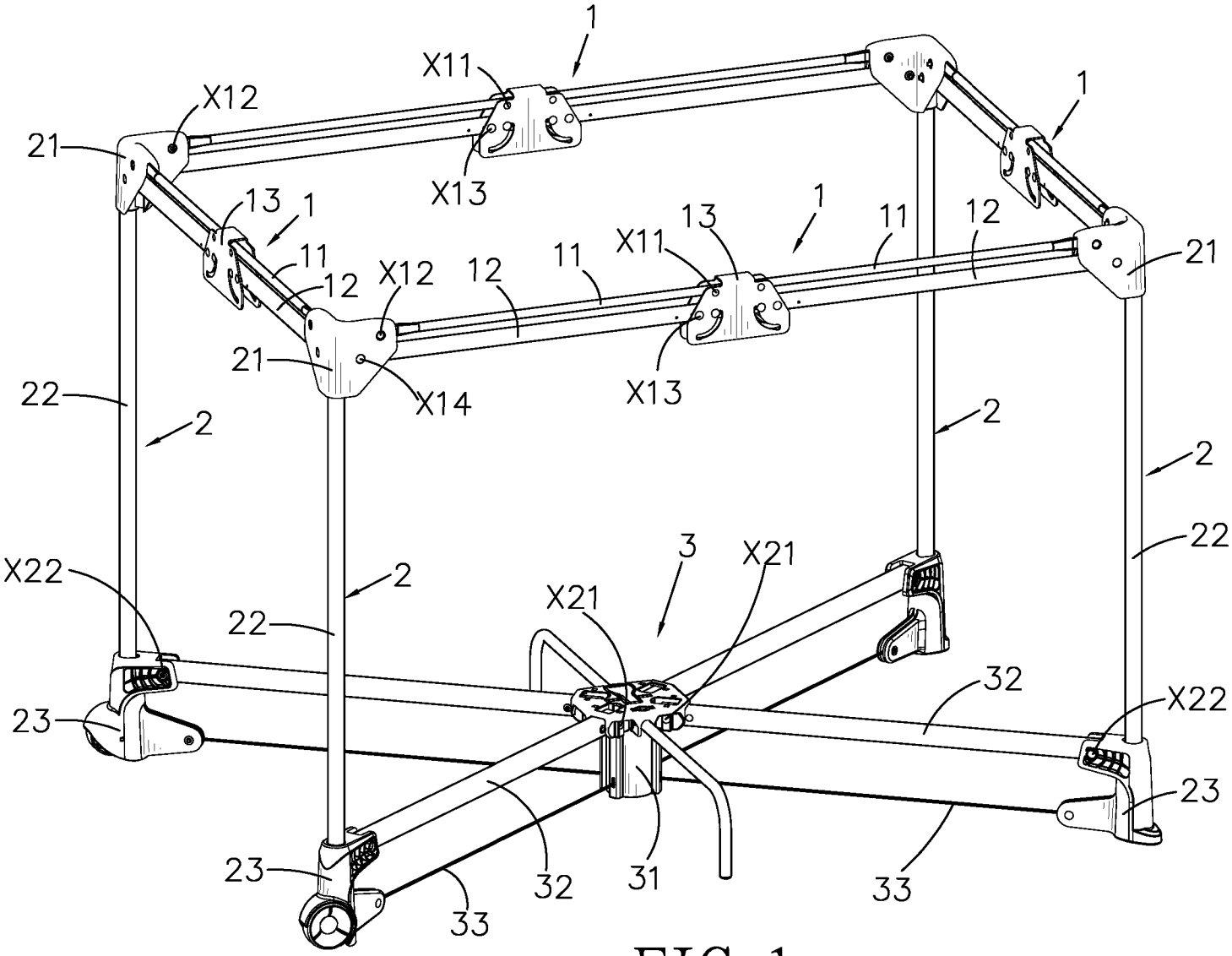
FIG. 1 is a perspective view of a travel cot in accordance with the present invention, shown in an expanded state.
Figure 2:
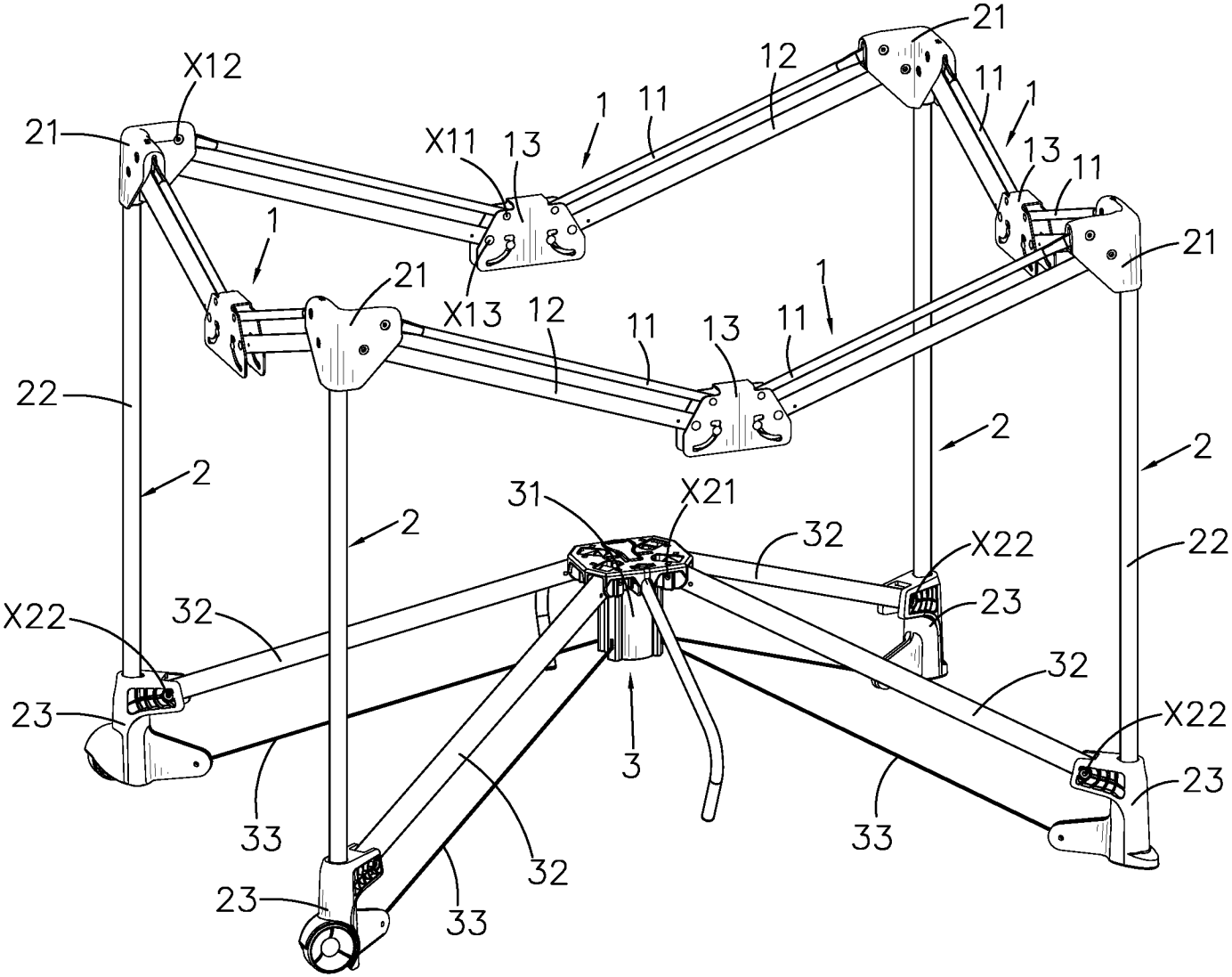
FIG. 2 is a perspective view of the travel cot, shown in a folding process.
Figure 3:
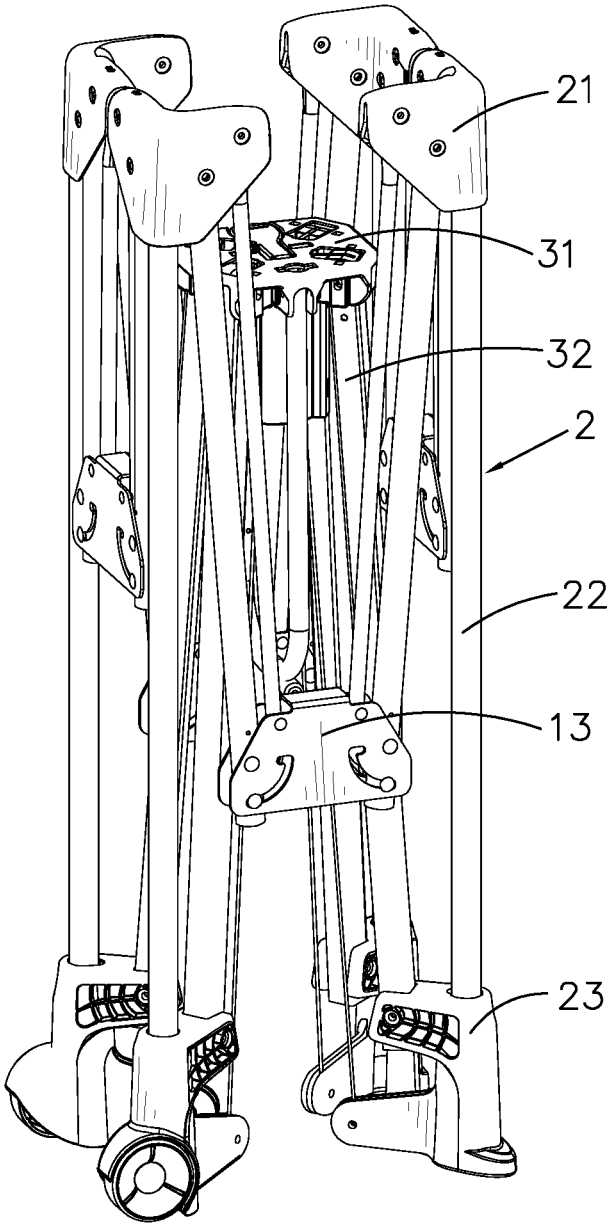
FIG. 3 is a perspective view of the travel cot, shown in a folded state.

With reference to FIGS. 1 to 3, a travel cot in accordance with the present invention has four lateral fences 1, four vertical posts 2, and a bottom frame 3. Each one of the vertical posts 2 has an upper corner unit 21, a vertical rod unit 22, and a foot unit 23. The four lateral fences 1 are connected to the two upper corner units 21 of the adjacent two of the vertical posts 2 respectively. The bottom frame 3 is foldable and disposed among the four foot units 23, and connects with the four foot units 23. Two lateral locks 14 are mounted on a middle part of each one of the lateral fences 1. Each one of the lateral locks 14 is capable of switching between a locked state and an unlocked state via adjusting a distance between adjacent two of the vertical posts 2 and/or adjusting angles of adjacent two of the vertical posts 2. To be more precise, said angles refer to tilting angles of the vertical posts 2.

When in use, the travel cot may further need a sheet, which is not shown in the figures in order to present a better view about the structure of this embodiment.

The bottom frame 3 has a central body 31, four bottom rods 32, and four ropes 33. The central body 31 is disposed at a bottom central region of the travel cot. Each one of the bottom rods 32 is disposed between the central body 31 and one of the vertical posts 2 respectively. The two ends of each one of the bottom rods 32 include an inner end and an outer end, and the inner end of the bottom rod 32 is rotatably connected to the central body 31 while the outer end of the bottom rod 32 is rotatably connected to a corresponding one of the vertical posts 2. To be more precise, the inner end of each one of the bottom rods 32 is rotatably connected to the central body 31 via a bottom second pivot X21, and the outer end of each one of the bottom rods 32 is rotatably connected to the foot unit 23 of the corresponding vertical post 2 via a bottom first pivot X22.

The four ropes 33 are non-stretchable and extend outward from the central body 31. Each one of the ropes 33 has an outer end portion. The outer end portions of the ropes are rotatably connected to the foot units 23 of the vertical posts 2 respectively. Connecting sites of the outer end portions of the ropes 33 to the foot units 23 are located beneath the bottom first pivot X22. The four ropes 33 extending outward from the central body 31 may be two ropes crossing each other in the middle and the intersection of the two ropes is mounted on the central body 31, or may be four independent ropes which are connected to the central body 31.

In this embodiment, the inner end portions of the four ropes 33 may be rotatably connected to the central body 31 directly, and connect to sites which are located beneath the bottom second pivot X21.

The ropes 33 may be connected to the central body 31 and/or the vertical posts 2 via a tension adjusting mechanism (not shown in figures). The tension adjusting mechanism has a moving unit and a bolt. The moving unit is movably mounted at a bottom of the central body 31, and capable of moving up and down with respect to the central body 31 via the bolt. The bolt is mounted at the bottom of the central body, and an upper end of the bolt is movably connected to the moving unit. The inner end portions of the four ropes 33 are fixed on the moving unit and the four ropes 33 extend outward from the central body 31. A result of lengthening or shortening the ropes 33 is fulfilled through adjusting vertical position of the moving unit with the bolt.

Figure 4:
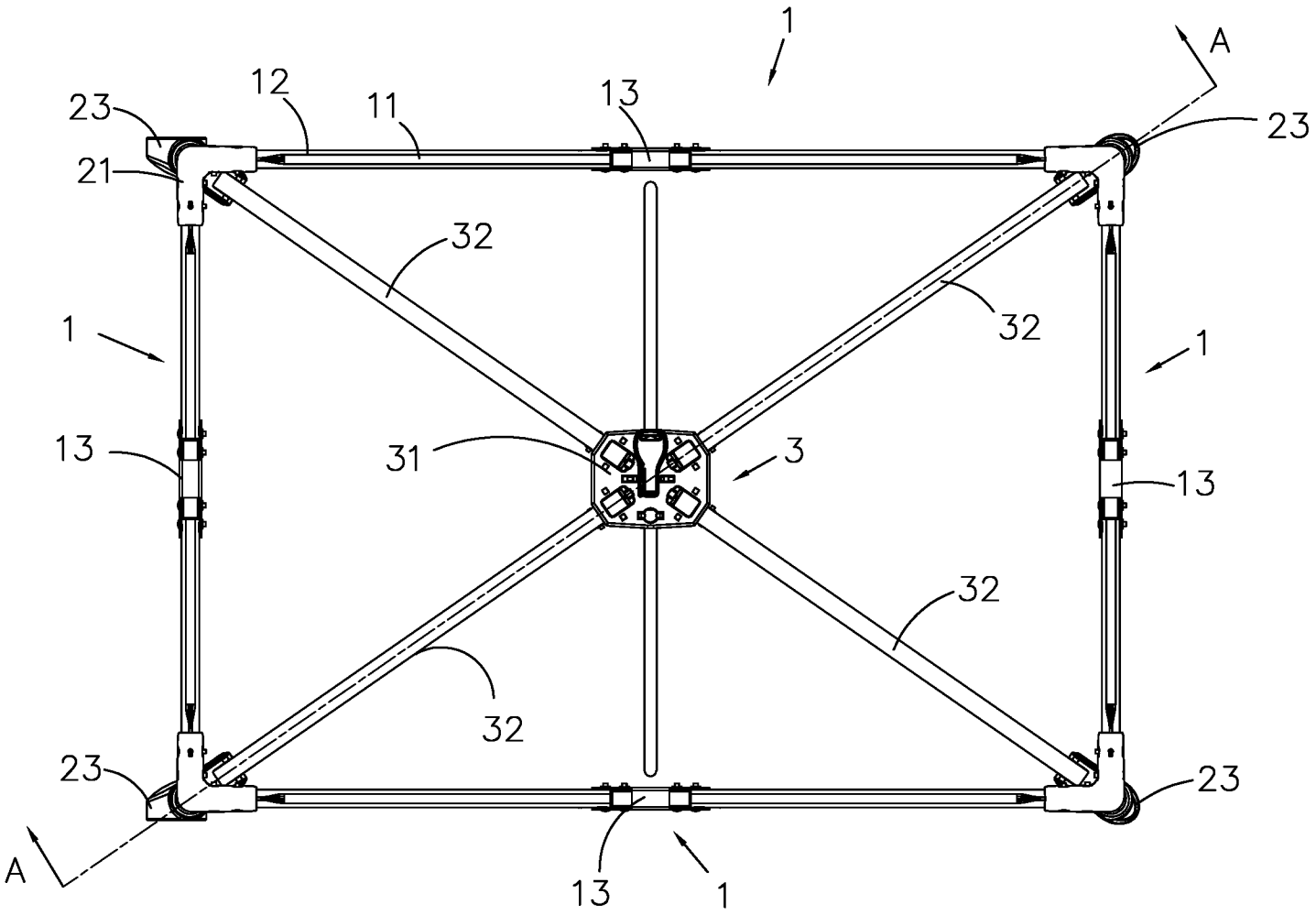
FIG. 4 is a top view of the travel cot in FIG. 1.
Figure 5:
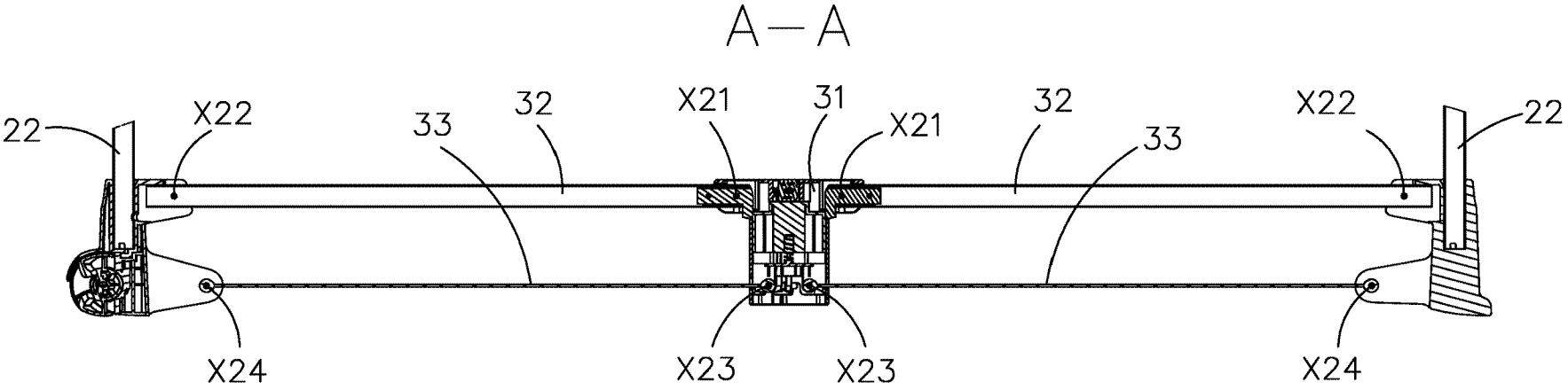
FIG. 5 is a cross-sectional view of the travel cot taken across line A-A in FIG. 4.

When the bottom frame 3 is expanded, the central body 31 moves downward to a limit position. The travel cot is in the expanded state when distances between each one of the vertical posts 2 and the central body 31 extend to a maximum. As shown in FIGS. 1, 4, and 5, each one of the ropes 33 is tautly mounted between the bottom end of the corresponding vertical post 2 and the central body 31. The top ends of the vertical posts 2 move outward and expand the lateral fences 1 as a result of collective work of the central body 31, the bottom rods 32, and the ropes 33. In the expanded state, each one of the ropes 33 may be parallel to the corresponding bottom rod 32.

Each one of the lateral fences 1 includes two surrounding frames, a middle unit 13, and two said lateral locks 14. The middle unit 13 is disposed between and connects with the two surrounding frames, and the middle unit 13 is rotatable with respect to the two surrounding frames. The lateral lock 14 is mounted between the middle unit 13 and each one of the surrounding frames; in other words, the two lateral locks 14 are symmetrically disposed between the two surrounding frames and the middle unit 13 respectively. Each one of the lateral locks 14 is capable of switching between a locked state and an unlocked state via adjusting a distance between adjacent two of the vertical posts 2 and/or adjusting angles of adjacent two of the vertical posts 2.

To be more precise, a steady standing state of adjacent two of the vertical posts 2 supplies two inverse tensions which are leaving away from each other to the two surrounding frames respectively, and thereby the lateral locks 14 are steadily positioned in the locked state, such that the travel cot is steadily positioned in the expanded state and locked.

In this embodiment, as shown in FIGS. 1 and 2, each one of the surrounding frames has an upper surrounding rod 11 and a lower surrounding bar 12. The upper surrounding rod 11 and the lower surrounding bar 12 are parallel to each other and disposed up and down with respect to each other when the travel cot is in the expanded state. One end of each one of the upper surrounding rods 11 is connected to the middle unit 13 via an upper first pivot X11, and another end of said upper surrounding rods 11 is connected to the corresponding vertical post 2 via an upper second pivot X12. An end of the lower surrounding bar 12 is capable of rotating around an upper third pivot X13 and slidingly mounted on the middle unit 13, another end of the lower surrounding bar 12 is rotatably connected to the corresponding vertical post 2 via an upper fourth pivot X14.

As shown in FIGS. 6 to 9, a slotted hole is disposed at one of the ends of each one of the lower surrounding bars 12, and the slotted hole extends along a length direction of said lower surrounding bar 12. The upper third pivot X13 passes through the slotted hole, and the upper third pivot X13 is fixed on a lateral part of the middle unit 13.

The two lateral locks 14 are symmetrically disposed between the two surrounding frames and the middle unit 13 respectively. Each one of the lateral lock 14 includes a locking pin 14*a*, an expanding guiding slot 14*b*, a folding guiding slot 14*c*, a position fixing slot 14*d*, a locking spring 14*e*, and an unlocking spring 14*f*.

The locking pin 14*a* is mounted on the lower surrounding bar 12 and capable of sliding along a length direction of the lower surrounding bar 12. The expanding guiding slot 14*b* is disposed on the middle unit 13 and extends along a radial direction of the upper third pivot X13, and the expanding guiding slot 14*b* is straight. The folding guiding slot 14*c* is disposed on the middle unit 13 and extends along a circumferential direction of the upper third pivot X13. The folding guiding slot 14*c* extends downward and forms an arced groove from an end of the expanding guiding slot 14*b*. The locking spring 14*e* is disposed between the locking pin 14*a* and the lower surrounding bar 12, and thus the locking pin 14*a* tends to move toward the upper third pivot X13.

A distance between the two upper first pivots X11 on the middle unit 13 is shorter than a distance between the two upper third pivots X13 on said middle unit 13. Similarly, a distance between the two upper second pivots X12 of the two adjacent vertical posts 2 is shorter than a distance between the two upper fourth pivots X14 on said two adjacent vertical posts 2.

Figure 6:
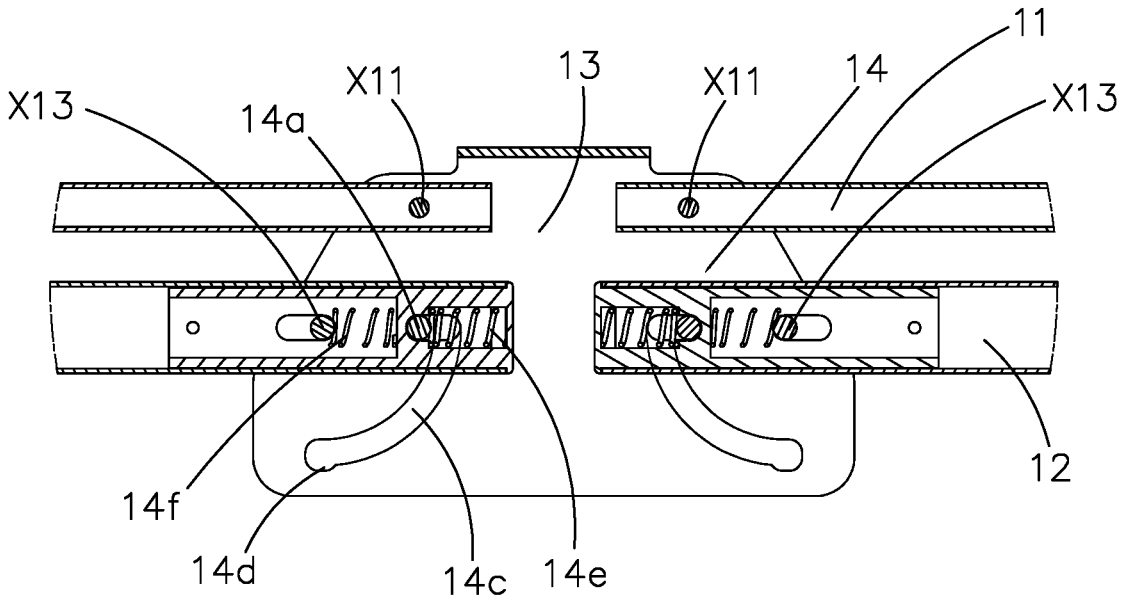
FIG. 6 is a front view of the lateral lock of the travel cot, shown in a locked state of the lateral lock in the expanded state of the travel cot.
Figure 7:
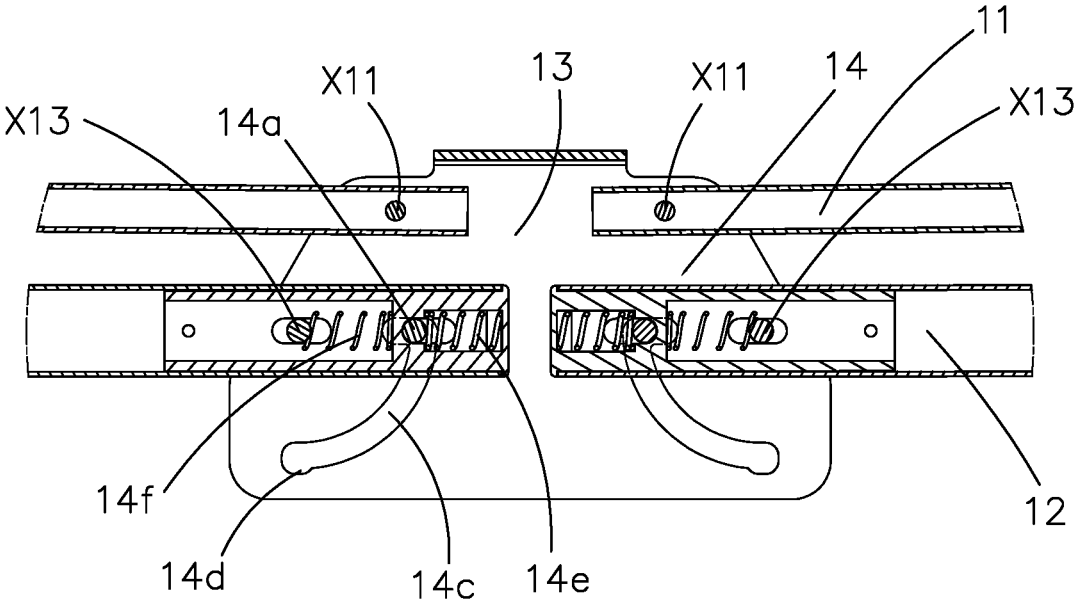
FIG. 7 is a front view of the lateral lock of the travel cot, shown in an unlocked state of the lateral lock.
Figure 8:
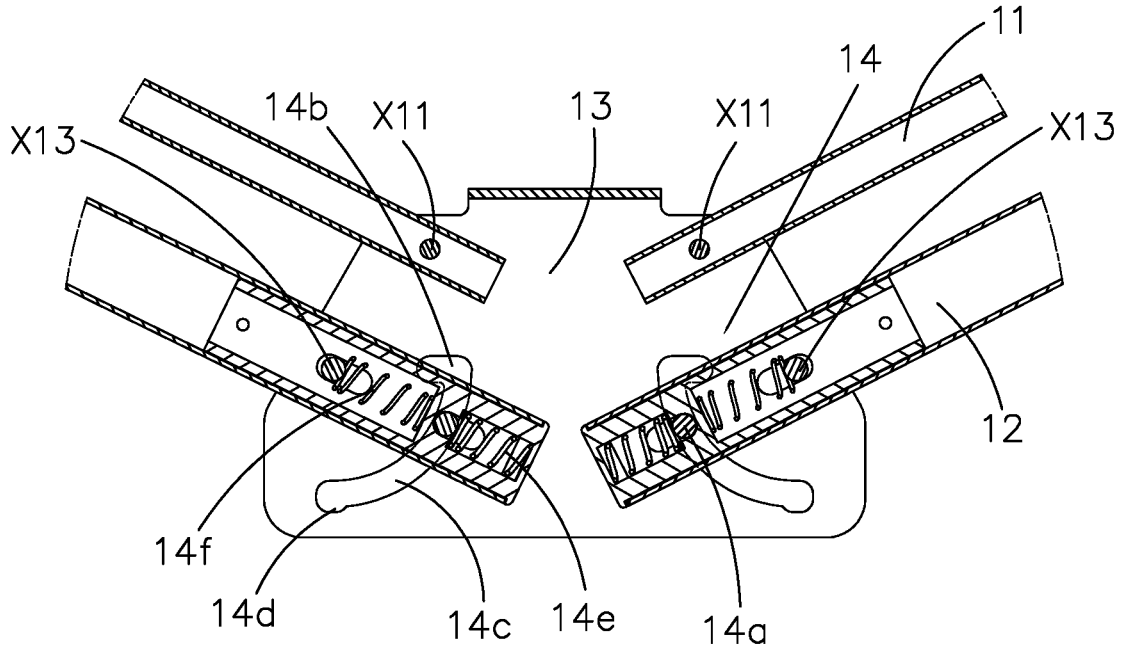
FIG. 8 is a front view of the lateral lock of the travel cot, shown in the folding process of the travel cot.
Figure 9:
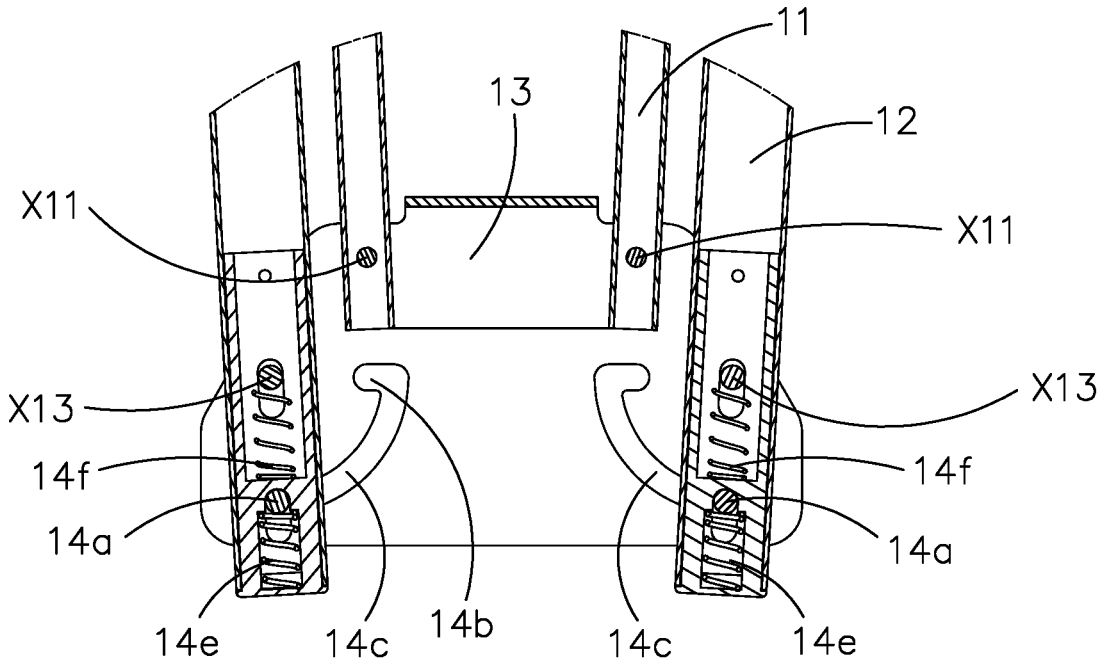
FIG. 9 is a front view of the lateral lock of the travel cot, shown in the folded state of the travel cot.

When it comes to folding the travel cot, as shown in FIGS. 1 and 6, the lateral locks 14 are in the locked state, each one of the locking pins 14*a* is inserted in the corresponding expanding guiding slot 14*b*, and the expanding guiding slot 14*b* extends along the length direction of the lower surrounding bar 12. Then the central body 31 is lifted and the foot unit 23 of each one of the vertical posts 2 gets closer to each other and moves to center, and thus all of the vertical posts 2 together form a shape like a funnel. In other words, all of the vertical posts 2 are tilted such that a distance between the bottom ends is shorter than a distance between the top ends of every adjacent two of the vertical posts 2. Each one of the locking pins 14*a* then easily moves out from the expanding guiding slot 14*b* and then enters the folding guiding slot 14*c* as shown in FIG. 7. When the central body 31 further moves upward and the middle units 13 move downward due to gravity, the vertical posts 2 gradually move closer to each other, as shown in FIGS. 2 and 8, each one of the locking pins 14*a* slides along the folding guiding slot 14*c*. As long as the locking pin 14*a* slides to a position as shown in FIG. 9, the folding process of the travel cot is complete, the travel cot is in the folded state as shown in FIG. 3. Furthermore, as shown in FIGS. 8 and 9, the position fixing slot 14*d* is connected to a lower end of the folding guiding slot 14*c*, and the position fixing slot 14*d* extends downward. When the travel cot is in the folded state, the locking pin 14*a* is in the position fixing slot 14*d* to fix the lower surrounding bar 12.

The unlocking spring 14*f* is mounted between each one of the lower surrounding bars 12 and the corresponding upper third pivot X13. The unlocking springs 14*f* are capable of pushing the lower surrounding bar 12 to start moving such that the locking pins 14*a* are easy to leave the expanding guiding slot 14*b* when the travel cot is going to be folded from the expanded state.

In the expanding process, the central body 31 moves downward and thus the foot unit 23 of each one of the vertical posts 2 moves away from center of the travel cot, and then the vertical posts 2 move away from each other to expand the lateral fences 1. The two upper surrounding rods 11 of each one of the lateral fences 1 expand via rotating with respect to the middle unit 13 around the upper first pivots X11 respectively. The lower surrounding bars 12 expand via rotating with respect to the middle unit 13 around the upper third pivots X13 respectively, and when the lower surrounding bars 12 are pulling to expand, the slotted hole offers a space for each one of the lower surrounding bars 12 to slide along the length direction with respect to the corresponding upper third pivot X13, whilst the locking springs 14*e* which abut the locking pins 14*a* are compressed.

When the central body 31 moves downward to the limit position, the ropes 33 get taut and the vertical posts 2 keep standing with the ropes 33 pulling; in other words, the vertical posts 2 would not fall or move toward center of the travel cot, and then the lateral fences 1 are fully expanded. Meanwhile, the locking pins 14*a* move to the expanding guiding slots 14*b* respectively, and then the locking springs 14*e* push the locking pins 14*a*; therefore, the lateral lock 14 switches into the locked state.

The structure of the travel cot in this disclosure is simple and thus easy to use, and the travel cot is capable of being folded or expanded in a single move. The travel cot is easy to lock or unlock in the process of expanding and folding, and the travel cot is steady in the expanded state, thereby being safe to use; on the other hand, the travel cot has a smaller volume when in the folded state, and the travel cot costs and weighs less than the conventional travel cots.

A bottom lock is mounted between the inner end of each one of the bottom rods 32 and the central body 31. The bottom lock is capable of positioning the corresponding bottom rod 32 with respect to the central body 31.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A travel cot having an expanded state and a folded state, the travel cot comprising:

multiple vertical posts;

multiple lateral fences being foldable, and each one of the lateral fences connecting with top ends of adjacent two of the vertical posts;

a bottom frame connecting with bottom ends of the vertical posts, the bottom frame including:

a central body disposed at a bottom central region of the travel cot;

multiple bottom rods rotatably mounted between the central body and the vertical posts respectively, and two ends of each one of the bottom rods including:

an inner end connected to the central body; and an outer end connected to a corresponding one of the vertical posts via a bottom first pivot;

multiple ropes being non-stretchable and extending outward from the central body, and an outer end portion of each one of the ropes connected to a connecting site of the bottom end of the corresponding vertical post, and the connecting site located beneath the bottom first pivot;

wherein the travel cot is in the expanded state when distances between each one of the vertical posts and the central body extend to a maximum, and each one of the ropes is tautly mounted between the bottom end of the corresponding vertical post and the central body, and the top ends of the vertical posts tend to expand;

wherein each one of the inner ends of the bottom rods is connected to the central body via a bottom second pivot; and wherein an inner end portion of each one of the ropes is connected to the central body at a site beneath the bottom second pivot.

2. The travel cot as claimed in claim 1, wherein each one of the ropes is parallel to a corresponding one of the bottom rods when the travel cot is in the expanded state.

3. The travel cot as claimed in claim 1, wherein the inner end portion of each one of the ropes is connected to the central body via a tension adjusting mechanism.

4. The travel cot as claimed in claim 1, wherein the outer end portion of each one of the ropes is connected to the corresponding vertical post via a tension adjusting mechanism.

5. The travel cot as claimed in claim 2, wherein the inner end portion of each one of the ropes is connected to the central body via a tension adjusting mechanism.

6. The travel cot as claimed in claim 2, wherein the outer end portion of each one of the ropes is connected to the corresponding vertical post via a tension adjusting mechanism.

7. The travel cot as claimed in claim 3, wherein:

the tension adjusting mechanism has:

a moving unit movably mounted at a bottom of the central body, and the moving unit capable of moving up and down with respect to the central body, the inner end portions of the ropes fixed on the moving unit; and a bolt mounted at the bottom of the central body, an upper end of the bolt movably or rotatably connected to the moving unit.

8. The travel cot as claimed in claim 4, wherein:

the tension adjusting mechanism has:

a moving unit movably mounted at a bottom of the central body, and the moving unit capable of moving up and down with respect to the central body, the inner end portions of the ropes fixed on the moving unit; and a bolt mounted at the bottom of the central body, an upper end of the bolt movably or rotatably connected to the moving unit.

9. The travel cot as claimed in claim 5, wherein:

the tension adjusting mechanism has:

a moving unit movably mounted at a bottom of the central body, and the moving unit capable of moving up and down with respect to the central body, the inner end portions of the ropes fixed on the moving unit; and a bolt mounted at the bottom of the central body, an upper end of the bolt movably or rotatably connected to the moving unit.

10. The travel cot as claimed in claim 1, wherein a bottom lock is mounted between the inner end of each one of the bottom rods and the central body.

11. The travel cot as claimed in claim 9, wherein a bottom lock is mounted between the inner end of each one of the bottom rods and the central body.

12. The travel cot as claimed in claim 1, wherein each one of the lateral fences includes:

two surrounding frames and a middle unit, the middle unit rotatably disposed between and connecting with the two surrounding frames; and a lateral lock mounted between the middle unit and each one of the two surrounding frames, the lateral lock capable of switching between a locked state and an unlocked state via adjusting a distance between adjacent two of the vertical posts and/or adjusting angles of adjacent two of the vertical posts.

13. The travel cot as claimed in claim 11, wherein each one of the lateral fences includes:

two surrounding frames and a middle unit, the middle unit rotatably disposed between and connecting with the two surrounding frames; and a lateral lock mounted between the middle unit and each one of the two surrounding frames, the lateral lock capable of switching between a locked state and an unlocked state via adjusting a distance between adjacent two of the vertical posts and/or adjusting angles of adjacent two of the vertical posts.

* * * * *